US005907119A

United States Patent [19]

Cranney

[11] Patent Number: 5,907,119

[45] Date of Patent: May 25, 1999

[54] METHOD OF PREVENTING AFTERBLAST SULFIDE DUST EXPLOSIONS

[75] Inventor: Don H. Cranney, South Jordan, Utah

[73] Assignee: Dyno Nobel Inc., Salt Lake City, Utah

[21] Appl. No.: 08/899,823

[22] Filed: Jul. 24, 1997

[51] Int. Cl.[6] ..... C06D 5/06; F42B 3/00; C06B 31/28

[52] U.S. Cl. ..... 102/289; 102/313; 149/49; 149/60; 149/83; 299/13

[58] Field of Search ..... 102/289, 290, 102/313; 149/46, 60, 61, 83; 299/13

[56] References Cited

U.S. PATENT DOCUMENTS

| | | | |
|---|---|---|---|
| 3,708,356 | 1/1973 | Mason et al. | 149/2 |
| 4,248,644 | 2/1981 | Healy | 149/21 |
| 4,338,146 | 7/1982 | Granlund | 149/109.6 |
| 4,500,369 | 2/1985 | Tag et al. | 149/2 |
| 4,872,929 | 10/1989 | Mullay | 149/61 X |
| 4,960,475 | 10/1990 | Cranney et al. | 149/61 X |
| 5,026,442 | 6/1991 | Yabsley et al. | 149/2 |
| 5,076,867 | 12/1991 | McKenzie | 149/60 X |
| 5,159,153 | 10/1992 | Cranney et al. | 102/313 |
| 5,271,779 | 12/1993 | Engsbraten | 149/60 X |
| 5,454,890 | 10/1995 | Evans et al. | 149/46 |
| 5,507,889 | 4/1996 | Mullay et al . | 149/83 X |
| 5,608,185 | 3/1997 | Granholm et al. | 149/108.4 |

FOREIGN PATENT DOCUMENTS 59013690 1/1984 Japan .

OTHER PUBLICATIONS

Bureau of Mines Report RI 7187.
Bureau of Mines Report RI 8373.
Bureau of Mines Report RI 8727.
Bureau of Mines Report RI 9632.

*Primary Examiner*—Peter A. Nelson

[57] ABSTRACT

The invention comprises a method of preventing afterblast sulfide dust explosions in blasting operations involving sulfide-containing ores, which method comprises (a) loading a borehole that has been drilled into a sulfide-containing ore body with an emulsion blasting agent that comprises an emulsifier, a continuous organic fuel phase, a density control agent, and a discontinuous oxidizer salt solution phase that comprises inorganic oxidizer salt(s), water and urea as a chemical inhibitor in an amount of from about 1% to about 10% by weight of the blasting agent, the blasting agent being loaded in a coupling relationship with the borehole; and (b) detonating the blasting agent.

8 Claims, No Drawings

METHOD OF PREVENTING AFTERBLAST SULFIDE DUST EXPLOSIONS

The present invention relates to a method of preventing afterblast sulfide dust explosions in blasting operations involving ores that contain a relatively high percentage of sulfides or pyrites. More particularly, the invention relates to a method that comprises (a) loading a borehole that has been drilled into a sulfide/pyrite-containing ore body with an emulsion blasting agent that contains urea as a chemical inhibitor in its discontinuous oxidizer salt solution phase and (b) detonating the blasting agent.

The chemical inhibitor used in the method of the present invention is urea in an amount of from about 1% to about 10% by weight of the blasting agent. The chemical inhibitor acts to suppress the rapid, energetic reaction of residual nitrates or $NO_x$ (that can be present following the detonation of the blasting agent) with reactive sulfide dust that may be present such as from the detonation itself.

BACKGROUND OF THE INVENTION

Sulfide dust explosions have occurred in underground mines in various parts of the world, particularly in mines where the ore body contains massive sulfide deposits that have sulfur contents as high as 50% or more. Although the sulfide concentration is deemed to be the major contributor to the explosion incident, other chemical, geologic or physical factors also may contribute to the propensity of a sulfide ore body to experience afterblast dust explosions.

A possible explanation for the dust explosion is that the flame generated by the detonating blasting agent ignites the sulfide dust generated by the detonation or blast itself (or the dust could be present from prior blasting or other mining activities). The resulting dust explosion can inflict considerable damage to a mine and present an injury potential to personnel within the mine. These explosions also can produce large quantities of sulfur dioxide and other noxious gasses that can permeate a mine's atmosphere for hours. Thus dust explosions result in substantial productivity losses in mining operations.

Attempts to control afterblast dust explosions have centered on: the type of explosives used, such as ANFO, packaged products, bulk products, etc.; reducing the incendivity characteristics of the explosives through formulation variations; the design and setup of the blast, including the use of stemming materials of various kinds; other precautions taken at the blast face to reduce or cool explosive flash, such as misting, hanging lime bags, etc.; and general cleanup or wetting of any dust in the drift and at the face. These approaches, although undoubtedly helpful, have been insufficient in the more difficult ore types where afterblast sulfide dust explosions occur with nearly every blast.

Emulsion blasting agents are well-known in the art, and in general, have superior properties to other commonly used blasting agents, such as ANFO or packaged blasting agents, in minimizing the potentiality of afterblast sulfide dust explosions. The use of an emulsion blasting agent by itself, however, is not sufficient to prevent afterblast sulfide dust explosions in all instances, and importantly it has been discovered in the present invention that the presence of a chemical inhibitor, preferably urea, functions as stated previously to suppress the rapid, energetic reaction of afterblast residual nitrates or $NO_x$ from reaction with sulfide dusts. Thus a critical element of the present invention is to add a chemical inhibitor to the emulsion blasting agent.

Urea has been used or suggested for use in water-bearing blasting agents of the emulsion or water-gel type and in ANFO blasting agents. However, specific uses in emulsions have been limited and have generally focused on obtaining specific effects. For example, U.S. Pat. No. 5,608,185 discloses the use of urea in the oxidizer salt solution phase of an emulsion blasting agent for purposes of reducing the formation of $NO_x$ fumes resulting from the detonation of the emulsion blasting agent. U.S. Pat. No. 5,159,153 discloses the use of urea in the oxidizer salt solution phase of an emulsion blasting agent for purposes of stabilizing the blasting agent against preblast thermal degradation in the presence of reactive sulfide and pyrite ores. U.S. Pat. No. 4,338,146 discloses the use of urea as an additive in a cap-sensitive emulsion explosive in an amount of less than 5% by weight to lower the crystallization point. U.S. Pat. No. 4,500,369 discloses the use of urea in an emulsion blasting agent to lower its crystallization temperature. U.S. Pat. No. 3,708,356 discloses the use of urea to stabilize ANFO against preblast reaction with pyrite ores. These patents do not suggest, however, the use of urea for the purposes described herein. As previously indicated, urea is not a "normal" ingredient in present commercial repumpable emulsions. In already fuel rich emulsions, it is generally considered to be undesirable to have water soluble fuels that, in effect, further limit the percentage of continuous phase (fuel phase) that can be used while still maintaining reasonable oxygen balance.

SUMMARY OF THE INVENTION

The invention comprises a method of preventing afterblast sulfide dust explosions in blasting operations involving sulfide-containing ores, which method comprises (a) loading a borehole that has been drilled into a sulfide-containing ore body with an emulsion blasting agent that comprises an emulsifier, a continuous organic fuel phase, a density control agent, and a discontinuous oxidizer salt solution phase that comprises inorganic oxidizer salt(s), water and urea as a chemical inhibitor in an amount of from about 1% to about 10% by weight of the blasting agent, the blasting agent being loaded in a coupling relationship with the borehole; and (b) detonating the blasting agent.

DETAILED DESCRIPTION OF THE INVENTION

The chemical inhibitor, urea, is added to the emulsion blasting agent either as part of the oxidizer salt solution phase or as a dry ingredient or both. The urea is added in an amount of from about 1% to about 10% by weight of the blasting agent and preferably from about 2% to about 6%.

The failure of the prior art attempts to control or minimize the occurrence of afterblast sulfide dust explosions in the more difficult ore types indicates that the ignition mechanism may be relatively unaffected by such attempts. An ignition mechanism may be occurring within the developing blast zone immediately following the detonation that involves the reaction of hot gaseous intermediates or products of detonation (most notably $NO_x$) and also possible traces of unreacted nitrate salts with newly formed ore dust. Such dust would be in a highly reactive state at the temperatures around the detonation zone and, since it is newly formed, would not be passivated by surface oxidation (unlike dusts present at the face before the blast). Since there is essentially no oxygen in the developing detonation zone, the hot, gaseous intermediates and products of the detonation reactions (and possibly, residual unreacted nitrate salts) are the only possible oxidizing species available to the dust, the most notable being $NO_x$ gases. The resulting oxidation of the ore particles by $NO_x$ or residual nitrates would further heat the particles and, as they spew out into the drift, the hot dust particles could react further with intermixed oxygen from the mine air, thus adding substantially to the overall heat and incentive nature of the blast and contributing to the ignition of additional sulfide dust with co-mingled oxygen in the mine air. If this mechanism is correct, then an $NO_x$ scavenger like urea could substantially suppress the reaction of $NO_x$ with the ore dust, thereby reducing or eliminating the contribution of this ignition mechanism to the onset of a sulfide dust explosion.

The immiscible organic fuel forming the continuous phase of the composition is present in an amount of from about 3% to about 12%, and preferably in an amount of from about 3% to less than about 7% by weight of the composition. The actual amount used can be varied depending upon the particular immiscible fuel(s) used, upon the presence of other fuels, if any, and the amount of urea used. To insure that some urea remains unreacted after detonation in order that it may prevent sulfide dust explosions, sufficient urea and organic fuel phase can be added to achieve an overall negative oxygen balance with the inorganic oxidizer salt component. Optionally the amount of organic fuel phase could be sufficient by itself to oxygen balance the inorganic oxidizer salt, and thus the urea need not react to a significant extent with the oxidizer salt during detonation. However, because the method of the present invention will be used primarily in underground operations, the oxygen balance should not be too negative or the formation of other noxious afterblast fumes, notably carbon monoxide, could result. Preferably the oxygen balance should be about 0 to −8.0 percent and more preferably −2.0 to −4.0%. Thus the relative amounts of immiscible fuel and urea can be adjusted as desired.

The immiscible organic fuels can be aliphatic, alicyclic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cotton seed oil, peanut oil, and soybean oil. Particularly preferred liquid fuels are mineral oil, No. 2 fuel oil, paraffin waxes, microcrystalline waxes, and mixtures thereof. Aliphatic and aromatic nitrocompounds and chlorinated hydrocarbons also can be used. Mixtures of any of the above can be used. For underground applications where the present invention normally would be practiced, the preferred organic fuel would be liquid at ambient temperatures to allow the blasting agent to be repumpable for ease of handling and loading.

The emulsifiers for use in the present invention can be selected from those conventionally employed, and are used generally in an amount of from about 0.2% to about 5%. Typically emulsifiers include sorbitan fatty esters, glycol esters, substituted oxazolines, alkylamines or their salts, derivatives thereof and the like, and polymeric emulsifiers, such as a bisalkanolamine or bis-polyol derivative of a bis-carboxylated or anhydride derivatized olefinic or vinyl addition polymer.

Optionally, and in addition to the immiscible liquid organic fuel and the urea, other fuels can be employed in selected amounts. To prevent the generation of incendive molten particles during detonation, additional fuels preferably should be liquid rather than solid.

The inorganic oxidizer salt solution forming the discontinuous phase of the explosive generally comprises inorganic oxidizer salt, in an amount from about 45% to about 95% by weight of the total composition, and water and/or water-miscible organic liquids, in an amount of from about 0% to about 30%. Since ammonium nitrate (AN) is potentially more reactive with sulfide dusts, preferably other salts may be used to replace some or all of the AN in amounts generally up to about 50%. The other oxidizer salts are selected from the group consisting of alkali and alkaline earth metal nitrates, chlorates and perchlorates. Of these, sodium nitrate (SN) and calcium nitrate (CN) are preferred.

Water preferably is employed in amounts of from about 10% to about 30% by weight based on the total composition and more preferably from about 12% to about 25%. The use of water within this range helps cool or lower detonation temperatures compared to ANFO and most packaged products and thus helps prevent sulfide dust explosions.

Water-miscible organic liquids can at least partially replace water as a solvent for the salts, and such liquids also function as a fuel for the composition. Moreover, certain organic compounds also reduce the crystallization temperature of the oxidizer salts in solution. Miscible solid or liquid fuels in addition to urea can include alcohols such as sugars and methyl alcohol, glycols such as ethylene glycols, other amides such as formamide, amines, amine nitrates, and analogous nitrogen-containing fuels. As is well known in the art, the amount or type of water-miscible liquid(s) or solid(s) used can vary according to desired physical properties.

The emulsion preferably contains limited, if any, solid fuels other than possibly solid urea, if desired. However, the use of added solid oxidizer such as ammonium nitrate prills or other solid nitrate perchlorate or chlorate salts as known in the art may be utilized as long as the product remains effective in preventing sulfide dust explosions.

The density control agent can comprise chemical gassing agents that react chemically in the composition to produce gas bubbles. In addition to or in lieu of chemical gassing agents, hollow spheres or particles made from glass, plastic or perlite may be added to provide density reduction. Since inert glass spheres may form incendive molten particles during detonation, whereas plastic spheres or microballons are consumed as a fuel, plastic microballons are the preferred solid density control agent. Additionally, and as taught in the art, mechanically generated gas bubbles or the addition of foams to reduce density and sensitize the emulsion can be used.

The emulsion of the present invention may be formulated in a conventional manner. Typically, the oxidizer salt(s), urea and other aqueous soluble constituents first are dissolved in the water (or aqueous solution of water and miscible liquid fuel) at an elevated temperature or from about 25° C. to about 90° or higher, depending upon the crystallization temperature of the salt solution. The aqueous solution then is added to a solution of the emulsifier and the immiscible liquid organic fuel, which solutions preferably are at the same elevated temperature, and the resulting mixture is stirred with sufficient vigor to produce an emulsion of the aqueous solution in a continuous liquid hydrocarbon fuel phase. Usually this can be accomplished essentially instantaneously with rapid stirring. (The compositions also can be prepared by adding the liquid organic to the aqueous solution). Stirring should be continued until the formulation is uniform. Solid additions such as solid density control agents (preferably of the plastic type) and optionally solid urea or oxidizers can then be blended into the formulation. When gassing is desired, the gassing agents are added and mixed homogeneously throughout the emulsion to produce uniform gassing at the desired rate. Also, the solid ingredients, if any, can optionally be added along with the gassing agents and stirred throughout the formulation by conventional means. However, further handling should quickly follow the addition of the gassing agent, depending upon the gassing rate, to prevent loss or coalescence of gas bubbles.

It has been found to be advantageous to pre-dissolve the emulsifier in the liquid organic fuel prior to adding the organic fuel to the aqueous solution. This method allows the emulsion to form quickly and with minimum agitation. However, the emulsifier may be added separately as a third component if desired.

Reference to the following table further illustrates this invention. Table I gives formulations and detonation results of stabilized emulsions for use in reactive ores subject to afterblast dust explosives. Examples 2 and 4 are preferred in that they both contain second oxidizer salts and preferred density reduction means, i.e., plastic microballoons and chemical gassing, respectively. As described below, the effectiveness of the formulation set forth in Example 2 of Table I was demonstrated successfully in tests at mine sites experiencing afterblast sulfide dust explosions.

Field Test 1

Field tests were conducted in a copper mine in an ore zone having a high concentration of sulfides. The sulfur content was in excess of 40%. Prior to the testing of the method of the present invention, blasting had been accomplished in this mine using ANFO with some packaged product. Mine personnel took several precautions to try to prevent sulfide dust explosions. These included stemming the hole with an inert cartridge, washdown of the blast area and use of a mist of water to suppress dust created by the blast. In spite of these precautions, afterblast sulfide dust explosions occurred regularly in this area of the mine.

A blast pattern was loaded with the stabilized emulsion blasting agent of Example 2 in Table I. All other precautions normally taken with ANFO also were taken in this instance. The blast did not produce an afterblast dust explosion, and the fracturing results were equivalent to, if not better than, that obtained by ANFO. A second pattern was loaded in the same drift, but the additional precautions were not taken. Again, the blast produced no afterblast sulfide dust explosion and blast results were good. As a comparison, a third pattern was loaded in the same drift with ANFO, together with the utilization of all the specified precautions. A violent afterblast sulfide dust explosion resulted, and more than 200 feet of ventilation tubing was damaged. A fourth shot consisted of another round loaded in the same drift with the stabilized emulsion of Example 2. No additional precautions were taken. The blast produced no afterblast sulfide dust explosion and gave excellent blast results.

Field Test 2

Further field tests were conducted in a copper and zinc mine in development headings where the sulfur content of the sulfide ores was 45% or greater. In this mine, the prior use of standard water gel and ANFO products caused afterblast sulfide dust explosions with each blast. These explosions occurred despite several precautions which included shooting one round at a time (previous experience at the mine indicated that multiple blasts increased the likelihood of a sulfide dust explosion), washing down the drift walls and back, and applying a mist of water at the face. In fact, the mine had discontinued blasting in this drift due to the constant occurrences of sulfide dust explosions.

A complete round was loaded with the stabilized repumpable emulsion blasting agent of Example 2 in Table I. For this round, all precautions were taken that were normally used, as outlined above. The blast produced no afterblast sulfide dust explosion, as evidenced by a lack of any gasses normally detected following such incidents and by a visual inspection of the blast area. Blast results were good. Another test was conducted in the same area, but this time none of the normal precautions were taken. Also two shots were loaded in the same drift (one round and one slash) and simultaneously detonated. Despite the absence of the specified precautions, no afterblast sulfide dust explosion occurred with the Example 2 formulation, and blast results were good. A third test was conducted in the same area, but included five separate loading points (two rounds and three slashes) for the stabilized emulsion of Example 2. No other precautions were taken. Because of the multiple loading, the mine personnel felt confident that a sulfide dust explosion likely would occur. The blast produced good results and no sulfide dust explosion occurred.

Further tests were conducted in the second mine in both drifts and stopes and in other areas of high sulfide content that had a previous history of sulfide dust explosions. The emulsion of Example 2 did not create a single afterblast sulfide dust explosion. Following this testing, the mine attempted to blast in the same areas with a prior art bulk emulsion that was not stabilized and thus did not contain urea, and sulfide dust explosions occurred in this instance.

While the present invention has been described with reference to certain illustrative examples and preferred embodiments, various modifications will be apparent to those skilled in the art and any such modifications are intended to be within the scope of the invention as set forth in the appended claims.

TABLE I

Typical Stabilized Emulsions For Use in Reactive Ores Subject to Afterblast Dust Explosions

| | 1 | 2 | 3 | 4 |
|---|---|---|---|---|
| Ammonium Nitrate | 58.4 | 61.6 | 71.0 | 60.3 |
| Sodium Nitrate | — | 14.1 | — | — |
| Calcium Nitrate | 10.3 | — | — | 10.5 |
| Water | 18.7 | 15.4 | 16.7 | 18.3 |
| Urea | 5.6 | 2.8 | 5.4 | 4.7 |
| Mineral Oil | 4.6 | 5.0 | 4.5 | 5.0 |
| Emulsifiers | 0.4 | 0.5 | 0.4 | 1.0 |
| Plastic Microballoons | — | 0.6 | — | — |
| Glass Microballoons | 2.0 | — | 2.0 | — |
| Chemical Gassing Agents | | | | 0.2 |
| Density, g/cc | 1.20 | 1.20 | 1.20 | 1.10 |
| Minimum Booster, g Pentolite | 50 | 4.5 | 9 | 2 |
| Critical Diameter, mm | ≦50 | ≦32 | ≦50 | ≦32 |
| Detonation Velocity, m/sec | 5330 | 5450 | 5730 | 4600 |

What is claimed is:

1. A method of preventing afterblast sulfide dust explosions in blasting operations involving sulfide-containing ores, which method comprises (a) loading a borehole that has been drilled into a sulfide-containing ore body with an emulsion blasting agent that consists essentially of an emulsifier, a continuous organic fuel phase, a density control agent, and a discontinuous oxidizer salt solution phase that consists essentially of inorganic oxidizer salt, water and characterized by urea in an amount of from about 1% to about 10% by weight of the blasting agent, the blasting agent being loaded in a coupling relationship with the borehole; and (b) detonating the blasting agent.

2. A method according to claim 1 wherein the density control agent is selected from the group consisting of plastic microballoons and gas bubbles.

3. A method according to claim 1 wherein the inorganic oxidizer salt is selected from the group consisting of ammonium and alkali metal nitrates and perchlorates and alkaline earth metal nitrates and perchlorates.

4. A method according to claim 3 wherein the inorganic oxidizer salt is a combination of a major proportion of ammonium nitrate and a minor proportion of another nitrate or perchlorate.

5. A method according to claim 4 wherein the inorganic oxidizer salt is ammonium nitrate.

6. A method according to claim 1 wherein the organic fuel phase is a liquid organic fuel in an amount sufficient to oxygen balance the inorganic oxidizer salt.

7. A method of preventing afterblast sulfide dust explosions in blasting operations involving sulfide-containing ores, which method comprises (a) loading a borehole that has been drilled into a sulfide-containing ore body with an emulsion blasting agent that consists essentially of an emulsifier, a continuous organic fuel phase in an amount of from about 3% to about 12% by weight of the blasting agent, a density control agent, and a discontinuous oxidizer salt solution phase that consists essentially of inorganic oxidizer salt in an amount of from about 45% to about 95%, water in an amount of from about 10% to about 30%, and characterized by urea in an amount of from about 1% to about 10% by weight of the blasting agent, the blasting agent being loaded in a coupling relationship with the borehole; and (b) detonating the blasting agent.

8. A method according to claim 7 wherein the urea is present in an amount of from about 2% to about 6%.

* * * * *